US006860821B2

(12) United States Patent
Unosawa et al.

(10) Patent No.: US 6,860,821 B2
(45) **Date of Patent: *Mar. 1, 2005**

(54) GOLF SHAFT, FORMING METHOD THEREFOR AND GOLF CLUB

(75) Inventors: Akira Unosawa, Saitama-ken (JP); Kazutaka Someno, Saitama-ken (JP)

(73) Assignee: Maimiya-OP Co., Ltd., Saitama-Ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/996,298

(22) Filed: Nov. 28, 2001

(65) Prior Publication Data

US 2002/0082112 A1 Jun. 27, 2002

(30) Foreign Application Priority Data

Dec. 25, 2000 (JP) ..... 2000-404626
Dec. 26, 2000 (JP) ..... 2000-404831
Jul. 30, 2001 (JP) ..... 2001-229971

(51) Int. Cl.[7] ..... A63B 53/10; A63B 53/12
(52) U.S. Cl. ..... 473/320
(58) Field of Search ..... 473/320, 321, 473/317, 318, 319, 322, 323

(56) References Cited

U.S. PATENT DOCUMENTS 5,049,422 A * 9/1991 Honma ..... 428/34.6
5,071,687 A * 12/1991 Shigetoh ..... 428/35.9
5,088,735 A * 2/1992 Shigetoh ..... 473/320
5,326,099 A * 7/1994 Yamamoto et al. ..... 473/315
5,385,767 A * 1/1995 Noguchi ..... 428/36.91
5,665,441 A * 9/1997 Suzue et al. ..... 428/34.7
6,126,557 A * 10/2000 Preece et al. ..... 473/320
6,139,444 A * 10/2000 Renard et al. ..... 473/320
6,306,047 B1 * 10/2001 Kusumoto ..... 473/319
6,354,960 B1 * 3/2002 Perryman et al. ..... 473/319
6,514,156 B1 * 2/2003 Zorzi ..... 473/319
6,533,677 B1 * 3/2003 Sumitomo et al. ..... 473/316

FOREIGN PATENT DOCUMENTS

JP 6-269522 * 9/1994

* cited by examiner

*Primary Examiner*—Stephen Blau
(74) *Attorney, Agent, or Firm*—Darby & Darby

(57) ABSTRACT

A golf shaft which features lightness, high crushing strength and high torsion strength with no interlayer peeling, as well as an excellent aesthetic design with a three-dimensional effect which gives the user a sense of depth, and a method for forming the same and a golf club using the same. The golf shaft is produced by baking a plurality of fiber prepreg layers. The shaft is a laminate comprising: a main layer of resin-impregnated high-strength high-elasticity fiber; a metal wire layer laid over the main layer; and a layer of low-elasticity fiber, laid over the metal wire layer, impregnated with resin through which the underlying metal wire layer can be seen.

41 Claims, 11 Drawing Sheets

GOLF SHAFT, FORMING METHOD THEREFOR AND GOLF CLUB

BACKGROUND OF THE INVENTION

1. Field of the Invention

The present invention relates to a golf shaft, a forming method therefor and a golf club.

2. Description of the Related Art

Generally speaking, a golf shaft is made by the filament winding method in which filaments as resin-impregnated high-strength high-elasticity fiber are wound on a mandrel and baked, or by the sheet winding method in which a prepreg as a sheet composed of such filaments aligned is wound on a mandrel and baked, so it has some degree of flexibility and a high rigidity. Also, when carbon fiber is used as high-strength, high-elasticity fiber, a lightweight golf shaft with a high strength can be produced. A golf club which uses this type of golf shaft is used by many users.

Regarding a golf shaft using carbon fiber, the flexural rigidity (bending strength), torsion strength, crushing strength and so on of a product (golf shaft) are considerably affected by the elasticity of the fiber used, the fiber's orientation with respect to the mandrel core (axis), its position along the length of the shaft or in the diametric direction and other factors.

When a head and a grip are attached to a golf shaft to make a finished golf club, the golf shaft strength characteristics as mentioned above also largely influence the carry and ball direction. For this reason, efforts to develop a golf shaft which meets user needs have been actively conducted.

Recently, in order to obtain a characteristic which cannot be achieved by carbon fiber only, many golf shafts which use a combination of carbon fiber and other materials have been developed: one example is that metal wires made of boron, titanium or a similar metal are arranged along the length of the shaft for the purpose of improving propagation of vibration upon impact and another is that metal wires are disposed as a reinforcement to a head mounting area with a smaller diameter and a low bending strength or torsion strength.

On the other hand, as a recent trend, there has been growing demand for the use in a golf shaft of a special metallic color which produces an aesthetic design effect, so golf shafts whose surface is coated with a metallic paint or metal-evaporated golf shafts are increasingly used.

However, although a metallic color can be developed on the golf shaft surface by decoration techniques such as coating with metallic paints and evaporation, it does not give the shaft an appearance with a sense of depth or a three-dimensional touch.

A metallic color can also be developed by densely aligning wires of titanium or other metal as mentioned above in a manner that they appear on the surface of a golf shaft. However, in that case, the weight is unavoidably increased and ideal strength characteristics are difficult to achieve.

In a golf shaft, a layer closer to the outer layer more affects the bending strength. Usually metal wires have circular cross sections and, therefore, occupy a large proportion of the shaft thickness, so it is difficult to achieve ideal strength characteristics (particularly bending strength) in terms of a strength-to-weight ratio.

Furthermore, in order to ensure visibility, the recent tendency is that metal wires are located in a layer nearer to the shaft surface than in an inner layer where metal wires were located previously. This means that many more metal wires have to be used than when metal wires were used in an inner layer. Besides, the weight of these metal wires is larger than carbon fiber. The result is an increase in the overall weight of the golf shaft.

In addition, because metal wires have a poor adhesion and are easy to peel off, a larger volume of synthetic resin for bonding them must be used to prevent their peeling, leading to an increase in the overall weight of a golf shaft.

SUMMARY OF THE INVENTION

An object of the present invention is to provide a golf shaft which features lightness, high crushing strength and high torsion strength without interlayer peeling and has an aesthetically excellent design that gives users a sense of depth, and a method for forming the same and a golf club using the same.

In order to achieve the above-said object, the present invention employs technical means as described below.

A golf shaft according to first aspect is produced by baking a plurality of fiber prepreg layers, wherein the shaft is a laminate composed of a main layer of high-strength high-elasticity fiber impregnated with resin; a metal wire layer laid over the main layer; and a low-elasticity fiber layer, laid over the metal wire layer, impregnated with resin through which the underlying metal wire layer can be seen.

A golf shaft according to second aspect is produced by baking a plurality of fiber prepreg layers, wherein the shaft is a laminate composed of a main layer of high-strength high-elasticity fiber impregnated with resin; a metal wire layer, laid over the main layer, having metal wires aligned bias or obliquely with respect to the axis (core) of the main layer; and a low-elasticity fiber layer, laid over the metal wire layer, impregnated with resin through which the underlying metal wire layer can be seen.

A golf shaft according to third aspect is produced by baking a plurality of fiber prepreg layers, wherein the shaft is a laminate composed of a main layer of high-strength high-elasticity fiber impregnated with resin; a metal wire layer laid over the main layer; and a low-elasticity fiber layer, laid over the metal wire layer, impregnated with resin through which the underlying metal wire layer can be seen, the metal wire layer consisting of a first metal wire layer having metal wires spaced and aligned bias with respect to the axis of the main layer; a transparent layer, laid over the first metal wire layer, as a coating of transparent material with a given thickness; and a second metal wire layer, laid over the transparent layer, having metal wires spaced and aligned bias in the direction opposite to that of the first metal wire layer.

A golf shaft according to fourth aspect is produced by baking a plurality of fiber prepreg layers, wherein the shaft is a laminate composed of a main layer of high-strength high-elasticity fiber impregnated with resin; a metal wire layer, laid over the main layer, having metal wires aligned bias with respect to the axis of the main layer; and a low-elasticity fiber layer, laid over the metal wire layer, impregnated with resin through which the underlying metal wire layer can be seen, the metal wire layer consisting of a first metal wire layer having metal wires spaced and aligned bias with respect to the axis of the main layer; a transparent layer, laid over the first metal wire layer, as a coating of transparent material with a given thickness; and a second metal wire layer, laid over the transparent layer, having metal wires spaced and aligned bias in the direction opposite to that of the first metal wire layer.

A golf shaft according to fifth aspect is produced by baking a plurality of fiber prepreg layers, wherein the shaft is a laminate composed of a main layer of high-strength high-elasticity fiber impregnated with resin; a metal wire layer laid over the main layer; and a low-elasticity fiber layer, laid over the metal wire layer, impregnated with resin through which the underlying metal wire layer can be seen, the metal wire layer consisting of a first metal wire layer having flat metal wires spaced and aligned bias with respect to the axis of the main layer; a transparent layer, laid over the first metal wire layer, as a coating of transparent material with a given thickness; and a second metal wire layer, laid over the transparent layer, having flat metal wires spaced and aligned bias in the direction opposite to that of the first metal wire layer.

A golf shaft according to sixth aspect is produced by baking a plurality of fiber prepreg layers, wherein the shaft is a laminate composed of a main layer of high-strength high-elasticity fiber impregnated with resin; a metal wire layer, laid over the main layer, having metal wires aligned bias with respect to the axis of the main layer; and a low-elasticity fiber layer, laid over the metal wire layer, impregnated with resin through which the underlying metal wire layer can be seen, the metal wire layer consisting of a first metal wire layer having flat metal wires spaced and aligned bias with respect to the axis of the main layer; a transparent layer, laid over the first metal wire layer, as a coating of transparent material with a given thickness; and a second metal wire layer, laid over the transparent layer, having flat metal wires spaced and aligned bias in the direction opposite to that of the first metal wire layer.

As the prepreg used for the low-elasticity fiber layer in the golf shafts according to first to sixth aspects, glass fiber prepreg is recommended.

As the thickness of the transparent layer in the golf shafts according to third to sixth aspects, a thickness from 10 im to 100 im is suitable.

As the prepreg used for the transparent layer in the golf shafts according to third to sixth aspects, glass fiber prepreg impregnated with resin having the same quality as the resin used in the main layer is recommended.

It is recommended that the metal wires according to second aspect, fourth aspect and fifth aspect be spaced with a spacing which is 0.5 to 2 times as large as the wire width.

Regarding the location of the metal wire layer according to first to sixth aspects, it is recommended that it be located near to the grip area along the length of the golf shaft.

The metal wire layer according to third to sixth aspects, which has a first metal wire layer and a second metal wire layer, may be located near to either the grip area or the head area along the length of the golf shaft.

When the metal wire layer according to first aspect has flat metal wires aligned circumferentially or perpendicularly to the axis of the main layer, it may be located near to either the grip area or head area along the length of the golf shaft.

When the metal wire layer according to first aspect has flat metal wires aligned in parallel with the axis of the main layer, it may be located near to either the grip area or head area along the length of the golf shaft.

A golf club according to the present invention uses the golf shaft according to first to 39th aspects, wherein a head is set on one end of the shaft and a grip covers the other end and the metal wire layer is located in the uncovered area between the head and grip.

A method for forming a golf shaft according to the present invention comprises the following steps: a step of making a main layer by winding resin-impregnated high-strength high-elasticity fiber around a tapered mandrel; a step of winding a first glass prepreg having metal wires aligned and bonded to it, around the larger diameter side of the main layer with the metal wires inside; and a step of winding a second glass prepreg, which has spaced and aligned flat metal wires bonded onto a glass fiber prepreg, around the first glass prepreg with the flat metal wires inside.

Another such method comprises: a step of making a main layer by winding resin-impregnated high-strength high-elasticity fiber around a tapered mandrel; a step of winding a laminate sheet having aligned metal wires between a prepreg of the same material as the main layer and a glass fiber prepreg, around the larger diameter side of the main layer with the glass fiber prepreg outside; and a step of winding a second glass prepreg having spaced and aligned flat metal wires bonded onto a glass fiber prepreg, around the laminate sheet with the flat metal wires inside.

A further such method comprises: a step of making a main layer by winding resin-impregnated high-strength high-elasticity fiber around a tapered mandrel; a step of winding a laminate sheet having aligned metal wires between a prepreg of the same material as the main layer and a glass fiber prepreg, around the larger diameter side of the main layer with the glass fiber prepreg outside; and a step of winding a glass sheet having spaced and aligned flat metal wires between two glass fiber prepregs, around the prepreg laminate.

Also, according to a shaft forming method in which after baking a fiber prepreg wound around a mandrel, the formed surface is ground to produce a fiber-reinforced shaft, a fiber prepreg with a different elasticity is partially placed as appropriate at least on the surface to be ground after baking; after baking, the whole surface of the formed shaft is uniformly ground to partially vary the flexural rigidity along the shaft.

According to another shaft forming method in which after baking a fiber prepreg wound around a mandrel, the formed surface is ground to produce a fiber-reinforced shaft, a low-elasticity prepreg is partially placed over the high-elasticity fiber prepress as appropriate at least on the surface to be ground after baking; after baking, the whole surface of the formed shaft is uniformly ground to make the area of the low-elasticity prepreg have a higher flexural rigidity than the other areas.

According to a further shaft forming method in which after baking a fiber prepreg wound around a mandrel, the formed surface is ground to produce a fiber-reinforced shaft, a low-elasticity glass fiber prepreg is partially placed over the high-elasticity fiber prepress as appropriate at least on the surface to be ground after baking; after baking, the whole surface of the formed shaft is uniformly ground to make the area of the low-elasticity prepreg have a higher flexural rigidity than the other areas.

When the forming method according to 26th aspect is used, it is desirable to have at least a metal fiber layer right under the above-said low-elasticity prepreg consisting of a glass fiber prepreg.

BRIEF DESCRIPTION OF THE DRAWINGS

FIG. 5A shows the structure of the first glass prepreg and FIG. 5B that of the second glass prepreg;

DETAILED DESCRIPTION OF THE PREFERRED EMBODIMENTS

Next, preferred embodiments of the present invention will be described in detail referring to the attached drawings.

Figure 1:
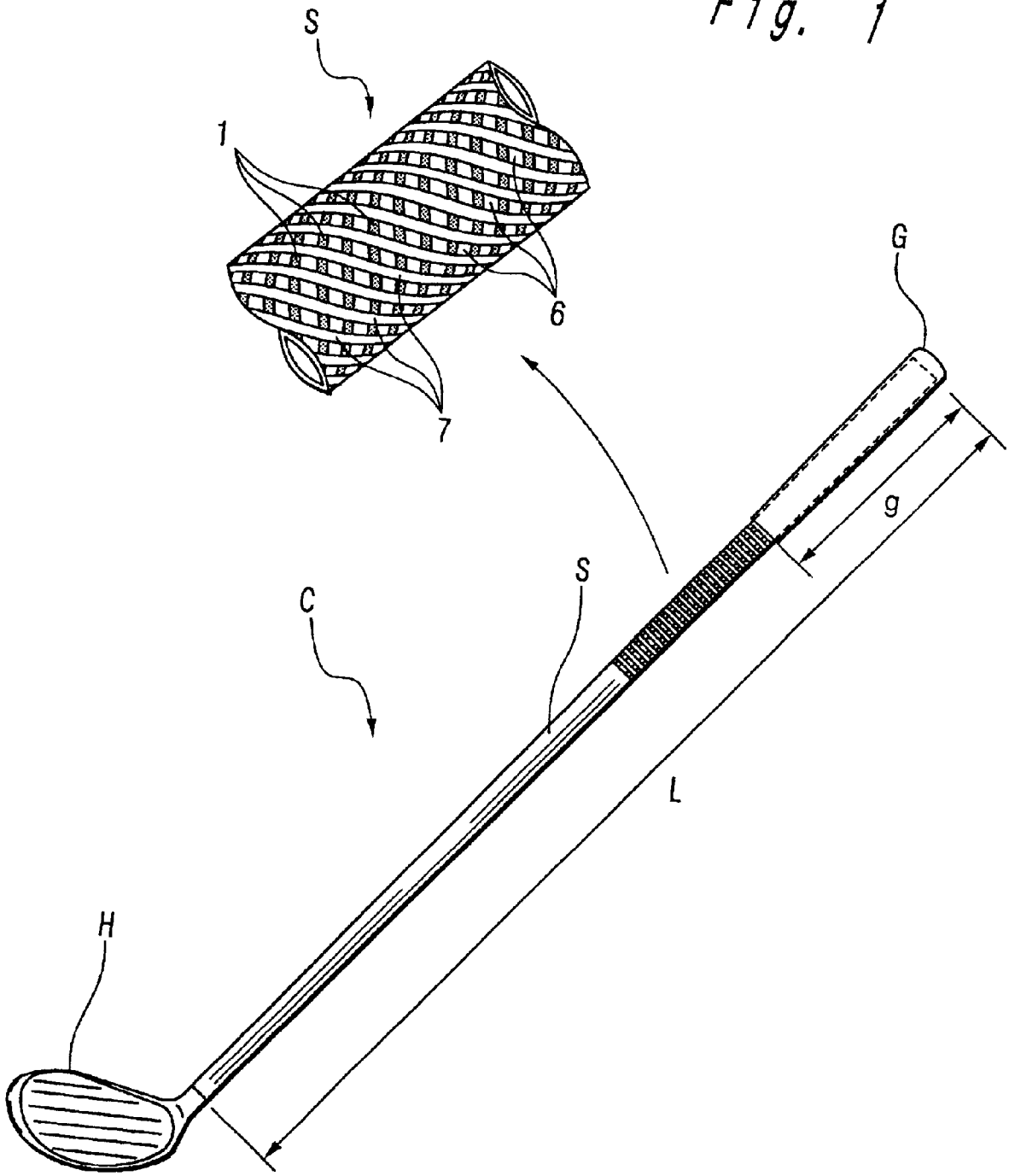
FIG. 1 is a perspective view of a golf club C according to the present invention including part of the golf shaft S used in the golf club C shown in enlarged form.
Figure 2:
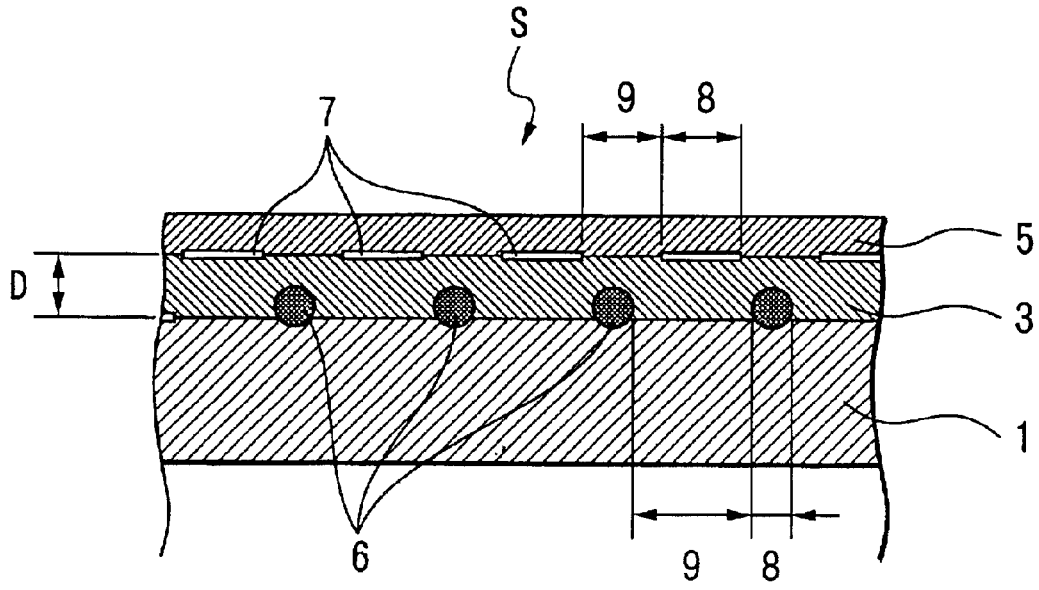
FIG. 2 is an enlarged sectional view showing the part of the golf shaft S shown in FIG. 1.

FIG. 1 shows a golf club C and, in enlarged form, part of the golf shaft S used in the golf club C according to one embodiment of the present invention. FIG. 2 is an enlarged sectional view showing the part of the golf shaft S shown in FIG. 1.

In this golf club C, a head H is set and bonded onto the smaller diameter end of a tapered golf shaft S and a grip G is fixed so as to cover an area away by a given distance from the larger diameter end.

The golf shaft S used in this golf club C is a laminate composed of a main layer 1 of high-strength high-elasticity fiber mainly impregnated with resin; metal wire layers 2 and 4 laid one upon the other over the main layer 1; and a low-elasticity fiber layer, laid over the metal wire layers, impregnated with resin through which the metal wire layers can be seen.

Typical materials which can be used for the high-strength, high-elasticity fiber are carbon fiber and glass fiber; boron fiber, aramid fiber, PBO fiber, etc. are also partially used. The synthetic resin used here may be thermosetting resin such as epoxy resin, phenol resin or unsaturated polyester.

In the golf shaft S according to the present invention, metal wires 6 and 7 are disposed in a given area on the main layer 1 in a manner that they can be seen from outside.

The metal wires 6 and 7 are disposed one upon another in the diametric direction of the golf shaft S, constituting at least a first metal wire layer 2 (under-layer) and a second metal wire layer 4 (over-layer), respectively.

There is a transparent layer 3 of transparent material between the first metal wire layer 2 and second metal wire layer 4 in a manner that the metal wire 6 (under-layer) can be seen from outside.

A protective layer 5 of the same material as the transparent layer 3 lies in succession on the second metal wire layer 4.

This means that the transparent layer 3 with a given thickness covers the first metal wire layer 2 (under-layer) and the second metal layer 4 and the protective layer 5 lie on the transparent layer 3.

The metal wire layers 2 and 4 respectively consist of metal wires 6 and 7 aligned bias at an angle from 10 to 80 degrees with respect to the shaft axis, wherein the first metal wire layer 2 and the second metal wire layer 4 are oriented oppositely to each other.

Preferably the metal wires 7 used for the second metal wire layer 4 should be flat. These flat metal wires 7 can be produced by flattening, for example, linear metal with a circular cross section using a rolling technique or any other similar technique.

The flat metal wires 7 are evenly spaced with a prescribed spacing so that the underlying first metal wire layer 2 can be seen through spaces 9 between the wires.

Materials for the metal wires 6 and 7 include titanium, aluminum, stainless steel and amorphous alloys; however, from the viewpoint of weight, strength and gloss (color), titanium is most desirable.

Transparent materials include synthetic resins such as transparent or translucent epoxy resin, and glass fiber impregnated with such resin. For a better adhesion with the main layer 1 or a better interlayer adhesion and prevention of interlayer peeling, it is desirable to use a synthetic resin of the same quality as the resin used for the main layer 1 or glass fiber impregnated with such resin.

In the golf shaft thus structured, since the flat metal wires 7 are used for the second metal wire layer 4, the visible surface area of the metal layer is larger and its occupied area in the diametric direction of the golf shaft S or its thickness is smaller.

Since the flat metal wires 7 can be bonded using a smaller amount of resin and are evenly spaced with a given spacing, the resin in the protective layer 5 melts and fuses with the resin in the transparent layer 3 through the spaces 9 between the wires. This increases the adhesion of the second metal wire layer 4 and thereby prevents interlayer peeling.

Figure 3:
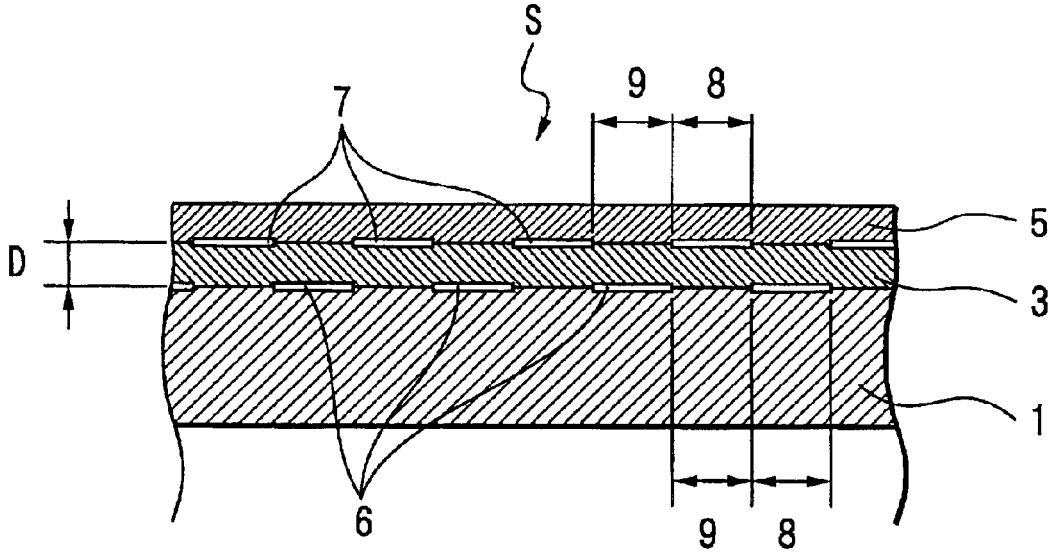
FIG. 3 is a sectional view of another form of what is shown in FIG. 2.

Furthermore, as shown in FIG. 3, it is acceptable to use flat metal wires 6 for the first metal wire layer 2. In this case, the thickness of the first metal wire layer 2 is decreased, which implies not only more latitude in the diameter of the golf shaft S but also a reduction in the amount of resin used.

The first metal wire layer 2 can be seen through the spaces 9 between the flat metal wires 7, 7 of the second metal wire layer 4; the viewer can see a lattice pattern made up by the first metal wire layer 2 and second metal wire layer 4 which are aligned in the opposite directions. Besides, the transparent layer 3, which lies between the first metal wire layer 2 and second metal wire layer 4, gives the viewer a sense of depth or produces a three-dimensional effect.

The thicker the transparent layer 3 is, the larger the three-dimensional effect is; however, a larger three-dimensional effect leads to an increase in the overall weight of the golf shaft S. In this sense, preferably the thickness should be from 10 μm to 100 μm.

Preferably, for a better visibility of the first metal wire layer 2 and the flat metal wires 7, the space 9 between flat metal wires 7, 7 should be 0.5 to 2 times as large as the width of the metal wires.

The metal wires 6 of the first metal wire layer 2 may be closely aligned with no spaces between them. However, it is also possible that like the flat metal wires 7, they are spaced with an appropriate spacing and the width 8 of the metal wires 6 and the spaces 9 between flat metal wires 7 are adjusted to create a complicated pattern as a combination of the main layer 1 and the first and second metal wire layers 2 and 4. In this case, the resin of the transparent layer 3 contacts the resin of the main layer 1 through the spaces 8 between metal wires 6, 6, so peeling of the first metal wire layer 2 can be prevented.

It is desirable that the metal wire layers 2 and 4 be located near to the grip area g along the length L of the golf shaft S. In this case, the metal wires 6 and 7 lie on the larger diameter side along the length L of the golf shaft S (tapered). In addition to the fact that the metal wires 6 and 7 are aligned bias or obliquely, this contributes to an increase in the crushing strength of the shaft. Furthermore, the metal wire layers 2 and 4 are formed only on part of the shaft, which means that the weight of the shaft is smaller than when the metal wire layers 2 and 4 are formed all over the length L of the shaft.

When the head H and grip G are attached to the golf shaft S to make up a golf club C, the grip G may cover part of the metal wire layers 2 and 4; however, it is desirable that the metal wires 6 and 7 lie somewhere in the uncovered area between the head H and grip G so that the user can see them. If so arranged, the golf shaft S can have a higher strength and the user of the golf club C can easily recognize the metal wire layers which give him/her a sense of depth or produce a three-dimensional effect.

Figure 14:
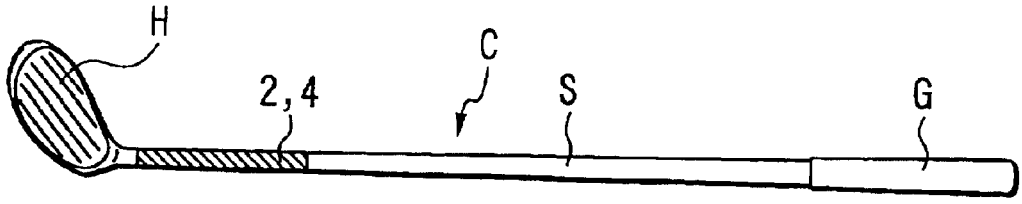
FIG. 14 is a perspective view of the golf club C whose metal wire layer (aligned bias) is located near to the head.

Alternatively, the metal wire layers 2 and 4 may be located near to the head area h along the length L of the golf shaft S as shown in FIG. 14. In this case, the metal wires 6 and 7 lie on the smaller diameter side along the length L of the golf shaft S (tapered). In addition to the fact that the metal wires 6 and 7 are aligned bias or obliquely, this contributes to an increase in the crushing strength and impact strength of the shaft. Furthermore, the metal wire layers 2 and 4 are formed only on part of the shaft, which means that the weight of the shaft is smaller than when the metal wire layers 2 and 4 are formed all over the length L of the shaft.

When the head H and grip G are attached to the golf shaft S to make up a golf club C, the head H may cover part of the metal wire layers 2 and 4; however, it is desirable that the metal wires 6 and 7 lie in the uncovered area between the head H and grip G so that the user can see them. If so arranged, the golf shaft S can have a higher strength and the user can easily recognize the metal wire layers which give him/her a sense of depth or a three-dimensional effect.

Figure 15:
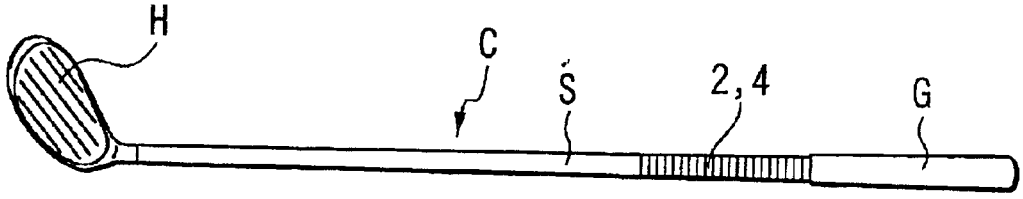
FIG. 15 is a perspective view of the golf club C whose metal wire layer (arranged circumferentially) is located near to the grip.

When the metal wire layers 2 and 4 are located near to the grip area g along the length L of the golf shaft S as shown in FIG. 15, the flat metal wires in the metal wire layers may be aligned circumferentially or perpendicularly to the axis of the main layer. In this case, the metal wires 6 lie in the circumferential direction, which contributes to an increase in the crushing strength of the shaft as in the case that the metal wires lie in the bias direction.

Figure 16:
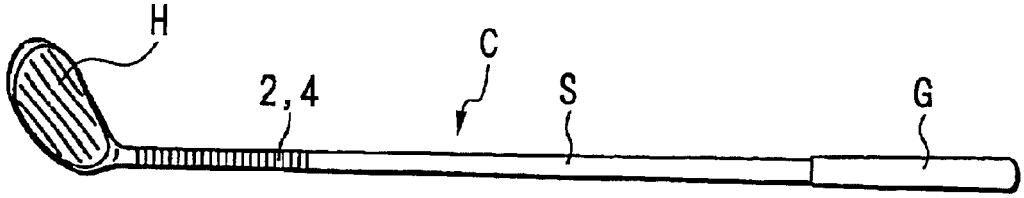
FIG. 16 is a perspective view of the golf club C whose metal wire layer (aligned circumferentially) is located near to the head.
Figure 17:
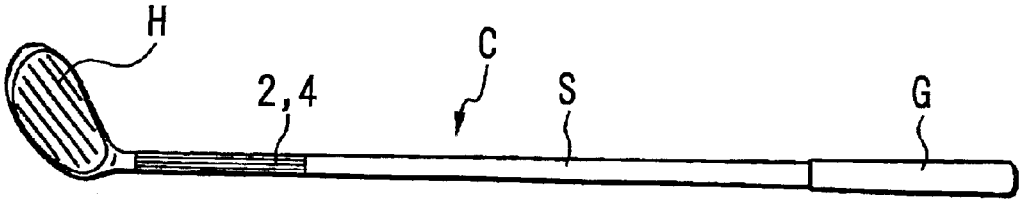
FIG. 17 is a perspective view of the golf club C whose metal wire layer (aligned in parallel with the shaft axis) is located near to the head.

FIGS. 16 and 17 show other examples of winding patterns of metal wires constituting metal wire layers, where the metal wire layers are located near to the head area h like the case shown in FIG. 14. FIG. 16 shows that the flat metal wires are aligned in the circumferential direction or perpendicularly to the axis of the main layer. FIG. 17 shows that the flat metal wires are aligned in parallel with the axis of the main layer. These cases ensure increased flexural rigidity and bending strength.

Next, the concrete process for forming the above-mentioned golf shaft will be explained.

Figure 4:
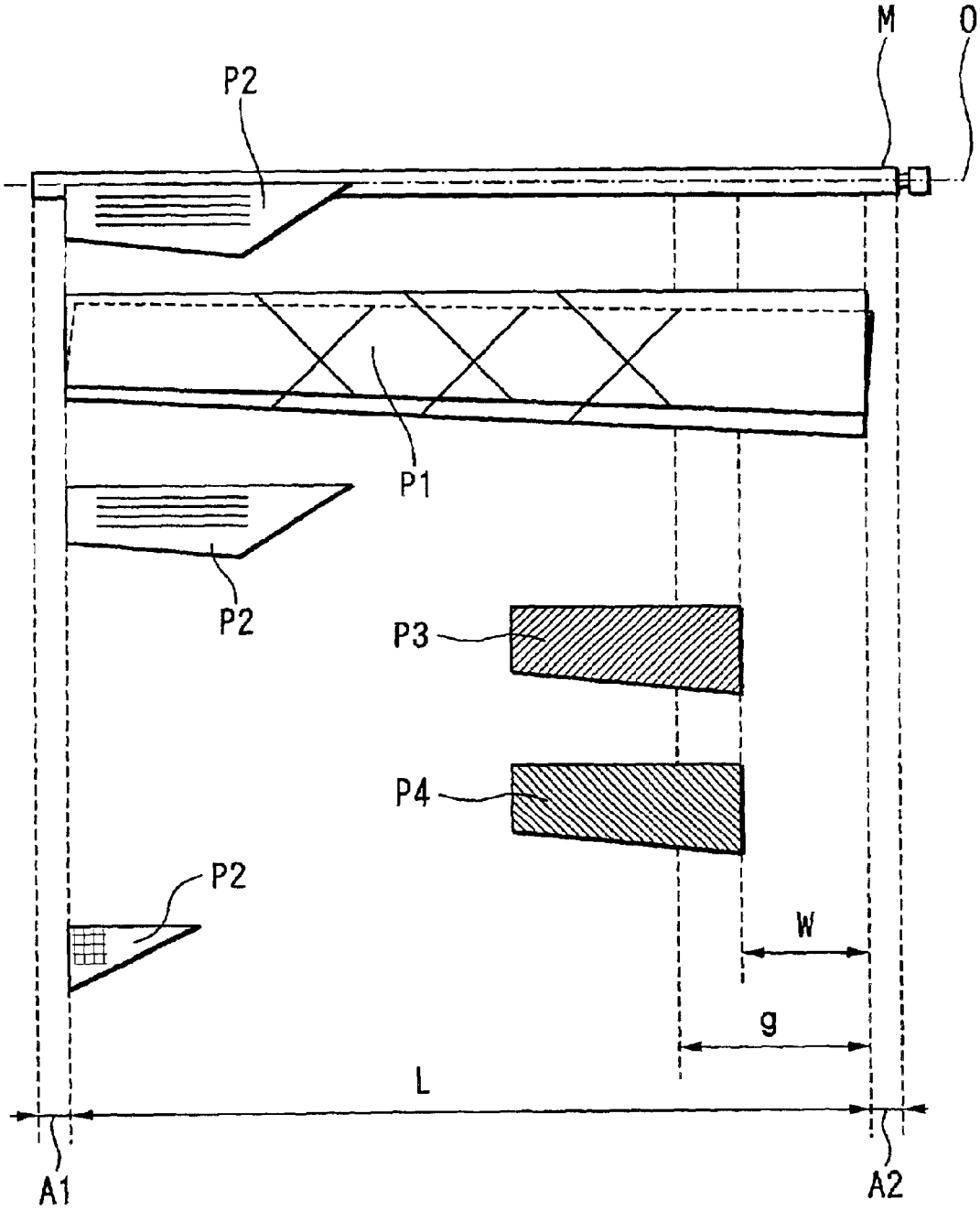
FIG. 4 shows an example of a process for forming a golf shaft according to the present invention.

FIG. 4 illustrates an example of the process for forming the golf shaft S; here the steps of winding prepregs on a mandrel M using the sheet winding method are shown.

This example assumes that a main prepreg P1 used here is typically a carbon fiber prepreg.

To meet the required characteristics, the main prepreg P1 is selectable from among the following types: a prepreg (straight layer) whose fiber is in parallel with the axis O of the mandrel M; a prepreg (hoop layer) whose fiber is perpendicular to the axis O of the mandrel M; and a prepreg (bias layer) whose fiber is oblique to the axis O of the mandrel M.

As illustrated here, first an auxiliary prepreg P2 is wound around the tapered mandrel M as necessary; then a bias prepreg (main prepreg P1) whose fiber is oblique to the axis O of the mandrel M is wound over it along the length of the mandrel. The auxiliary prepreg P2 and the bias prepreg (main prepreg P1) may be wound in the prescribed area of the mandrel M except the smaller diameter end area A1 and the larger diameter end area A2.

The bias prepreg P1, which consists of two prepreg sheets opposite in fiber orientation, is wound by 4 to 8 plies. Then, though not shown, a straight prepreg whose fiber is in parallel with the axis O is wound all over it.

Further, an auxiliary prepreg P2 for adjustment/alignment is wound over it at the tip side, where the orientation of the auxiliary prepreg fiber can be selected according to the purpose.

The main layer 1 is formed in this way.

Figure 5A:
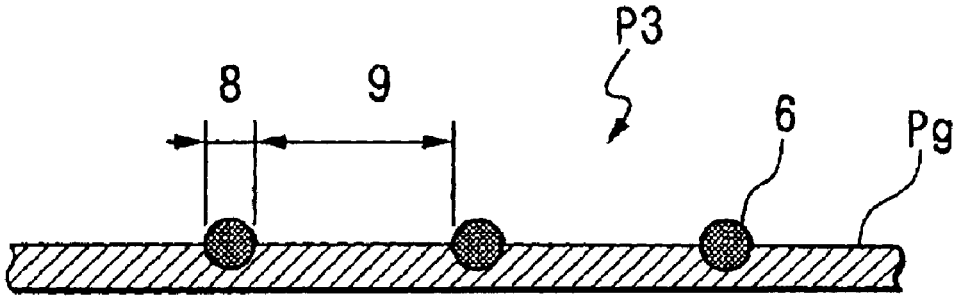
FIGS. 5A and 5B are sectional views showing the structures of prepregs used in the forming process as shown in FIG. 4, where
Figure 5B:
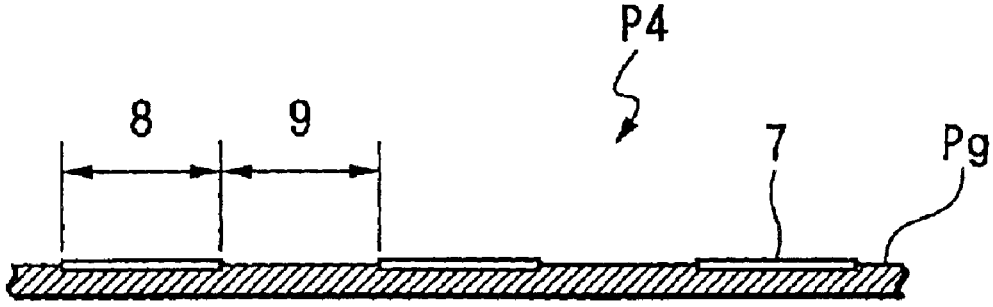

Next, a first glass prepreg P3 is wound on the main layer 1 at the larger diameter side. This first glass prepreg 3 consists of titanium wires (metal wires 6) aligned bias which are bonded to a glass fiber prepreg Pg, as shown in FIGS. 5A and 5B; it is wound with the titanium wires 6 inside (on the main layer 1). A first metal wire layer 2 and a transparent layer 3 are thus formed at a time.

As mentioned above, the first glass prepreg P3 is wound on the main layer 1 at the larger diameter side; however, usually a grip is put so as to cover the larger diameter side end in the process of finishing a golf shaft S.

If the metal wires 6 and 7 are wound on the grip area g, they are covered by the grip G and invisible, which not only makes them meaningless in producing an aesthetic effect on the shaft appearance but also increases the overall weight of the golf shaft S because they have to be wound on the largest diameter area.

On the other hand, when the metal wires 6 and 7 are wound, their cut ends are exposed in the boundary between the ends and the underlying main layer 1, producing an unfavorable effect on the shaft appearance.

In this sense, it is desirable that the ends of the metal wires 6 and 7 be covered by the grip which is later attached; preferably the first glass prepreg P3 should be wound 230 mm to 280 mm away from the larger diameter end of the main layer 1.

Then a second glass prepreg P4 is wound on the first glass prepreg P3. The second glass prepreg P4 consists of flat titanium wires 7 spaced and aligned bias which are bonded to a glass fiber prepreg Pg, as shown in FIGS. 5A and 5B; it is wound with the flat titanium wires 7 inside. A second metal wire layer 4 and a protective layer 5 are thus formed at a time.

Then, heat-shrinkable wrapping tape is wound on them before baking in a kiln. After baking, the mandrel M is pulled out and the shaft surface is ground and coated to finish the golf shaft S (not shown).

When the golf shaft S is formed in this way, the first metal wire layer 2 and the transparent layer 3, and the second metal wire layer 4 and the protective layer 5, are formed at a time, respectively. This improves the efficiency of the forming process and also enables production of a light golf shaft which features high crushing strength and torsion strength as well as an excellent design with a sense of depth.

If the golf shaft S is formed as mentioned above, the difference in the outer diameter between the area of the metal wires 6 and 7 and the smaller diameter side area of the main layer 1 would be considerable. Also at the smaller diameter side ends of the metal wire layers 2 and 4, the cut ends of the metal wires 6 and 7 are seriously exposed in the boundary between them and the underlying main layer 1, producing an unfavorable effect on the shaft appearance.

Figure 6:
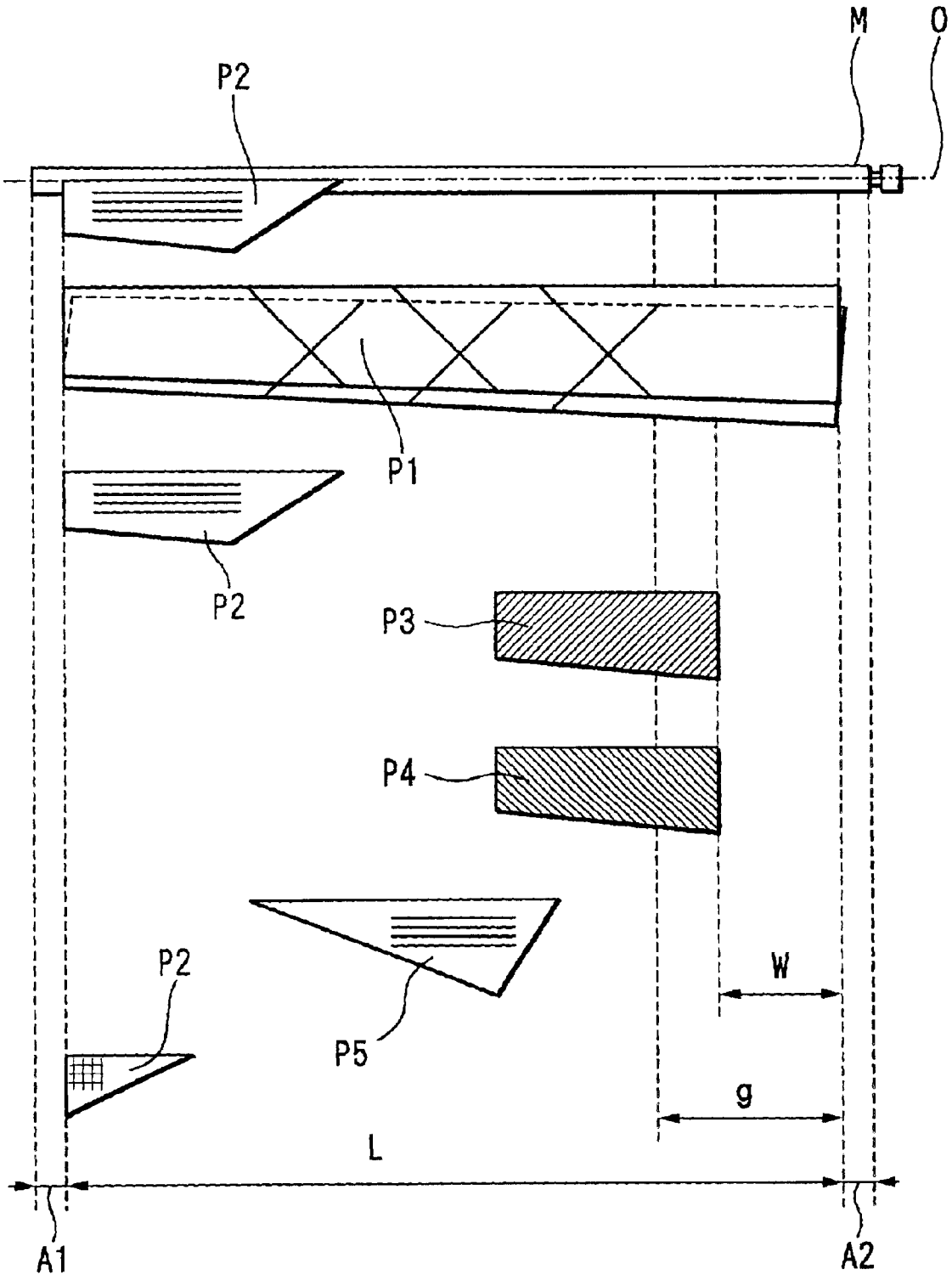
FIG. 6 shows another forming process.

As shown in FIG. 6, one solution may be that after the second metal wire layer 4 and protective layer 5 are formed, an auxiliary prepreg P5 for external appearance made of carbon fiber is wound from the area of the metal wires 6 and 7 to the smaller diameter side of the main layer and after baking, the surface is ground. This compensates for the level difference between the metal wire layers 2 and 4 and the main layer 1 to smoothen the surface and covers the ends of the metal wires 6 and 7, resulting in an improvement in the external appearance.

So far, an example of the process for forming the golf shaft S according to the present invention has been described; however, the invention is not limited thereto.

Figure 7:
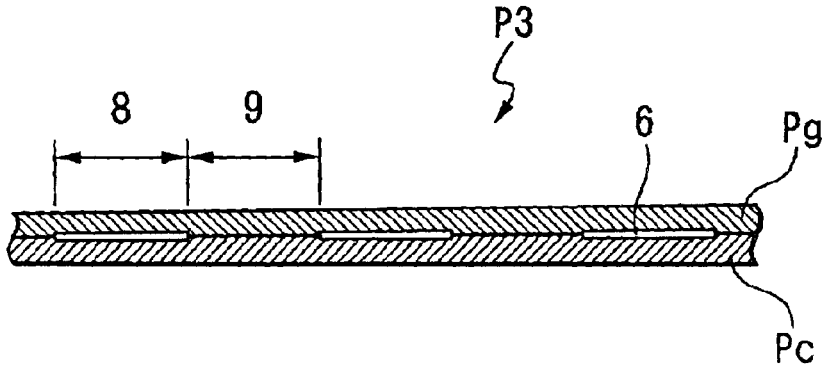
FIG. 7 is a sectional view showing another form of the first glass prepreg.

For instance, it is also acceptable that, as illustrated in FIG. 7, the first glass prepreg (sheet) P3 consists of titanium wires 6 between a carbon fiber prepreg Pc and a glass fiber prepreg Pg and is wound with the carbon fiber prepreg Pc inside or on the main layer 1 (glass fiber prepreg outside) to form a first metal wire layer 2 and a transparent layer 3.

Figure 8:
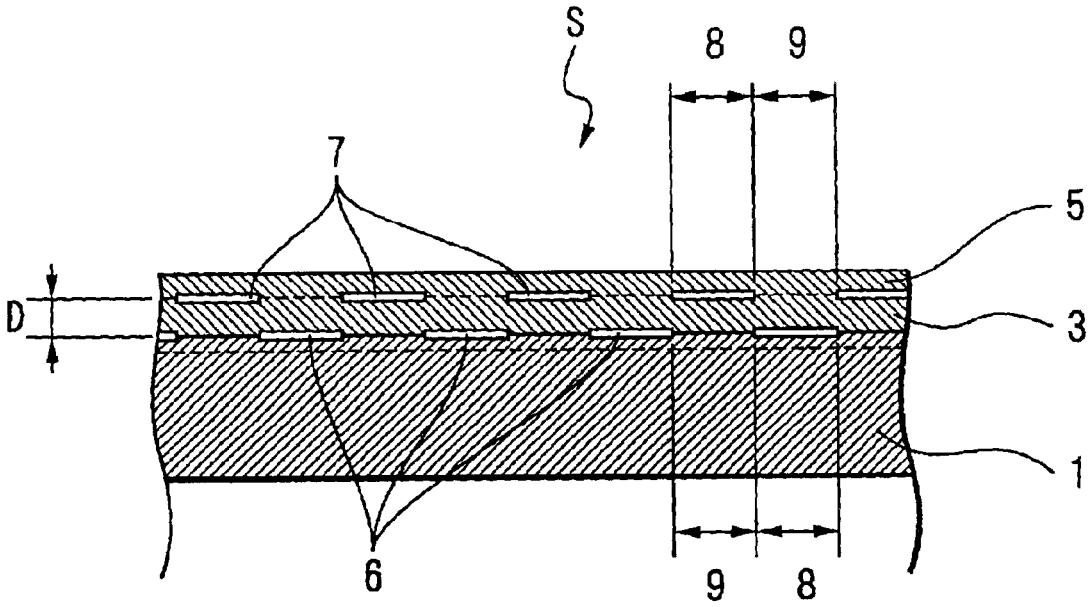
FIG. 8 is a sectional view showing a shaft using the prepreg shown in FIG. 7.

When the golf shaft S is thus formed, as shown in FIG. 8, the carbon fiber prepreg Pc of the first glass prepreg P3 is amalgamated with the main layer 1 to form a first metal wire layer 2 and a transparent layer 3 at a time.

Figure 9:
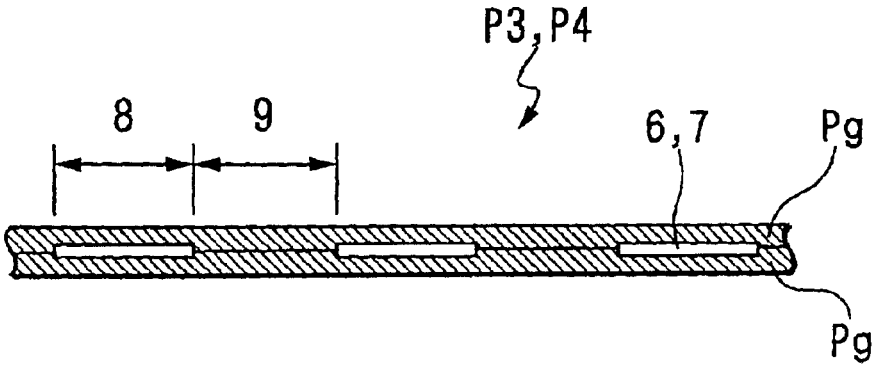
FIG. 9 shows another form of the prepregs shown in FIGS. 5A and 5B.

Another possible variation is shown in FIG. 9 in which the first glass prepreg P3 or the second glass prepreg P4 consists of titanium wires 6 or flat titanium wires 7 aligned bias between two sheets of glass fiber prepreg Pg, Pg.

Figure 10:
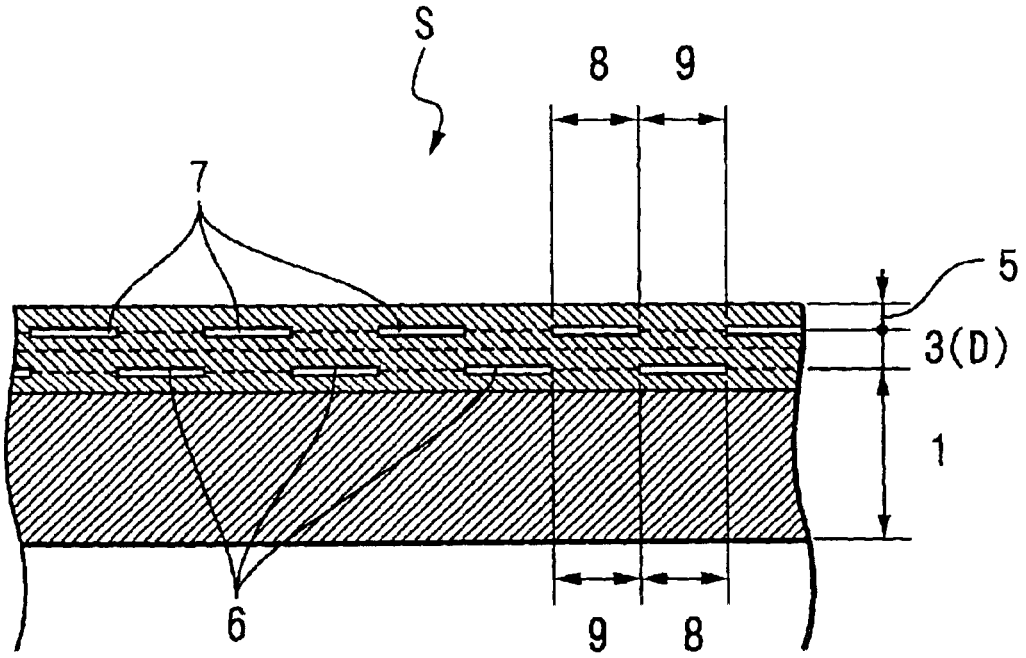
FIG. 10 is a sectional view showing a shaft using the prepreg shown in FIG. 9.

When the golf shaft S is thus formed, as shown in FIG. 10, a first metal wire layer 2 and a transparent layer 3 or a second metal wire layer 4 and a protective layer 5 are formed at a time. Part of the main layer 1 and the transparent layer 3 or the transparent layer 3 and the protective layer 5 are amalgamated and made to adhere to each other more closely, thereby preventing interlayer peeling.

When the first glass prepreg P3 or the second glass prepreg (glass sheet) P4 is thus structured and wound on the main layer 1 or the transparent layer 3, metal wires 6 or flat metal wires 7, which are more elastic than carbon fiber or glass fiber and less easy to wind, can be wound more easily.

It is also acceptable that the first glass prepreg P3 and the second glass prepreg P4 have the same structure having metal wires between two sheets of glass fiber prepreg and one of them is turned inside out to make the metal wire layers oriented in opposite directions. Therefore, because the same sheet material can be used, the material cost can be reduced.

Figure 12:
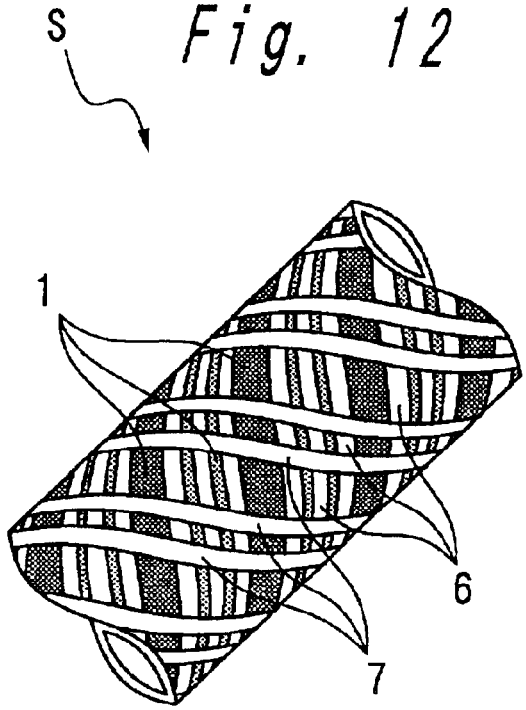
FIG. 12 shows another example of the part shown in enlarged form in FIG. 1.
Figure 13:
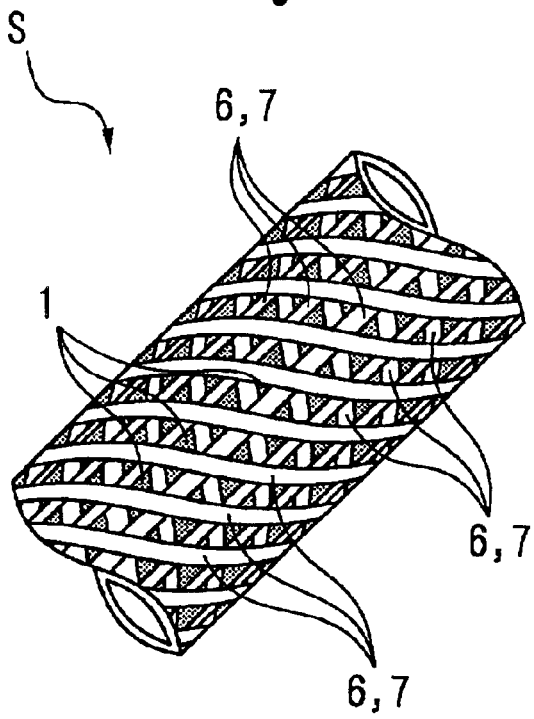
FIG. 13 shows another example of the part shown in enlarged form in FIG. 1.

Furthermore, all metal wires need not be evenly spaced; as shown in FIG. 12, the metal wires 6 and 7 may be spaced in a specific pattern. Thus, a variety of metal wire patterns can be created. Alternatively, as shown in FIG. 13, glass fiber prepregs which each have aligned metal wires (flat metal wires) 6 and 7 may be oriented in three directions: bias, counter-bias and straight. In this case, the metal wires (flat metal wires) 6 and 7 are aligned straight or in parallel with the shaft axis so that the bending strength is improved and vibration is easily conveyed. As a result, a golf club which provides a better feel of shot can be realized.

Figure 11:
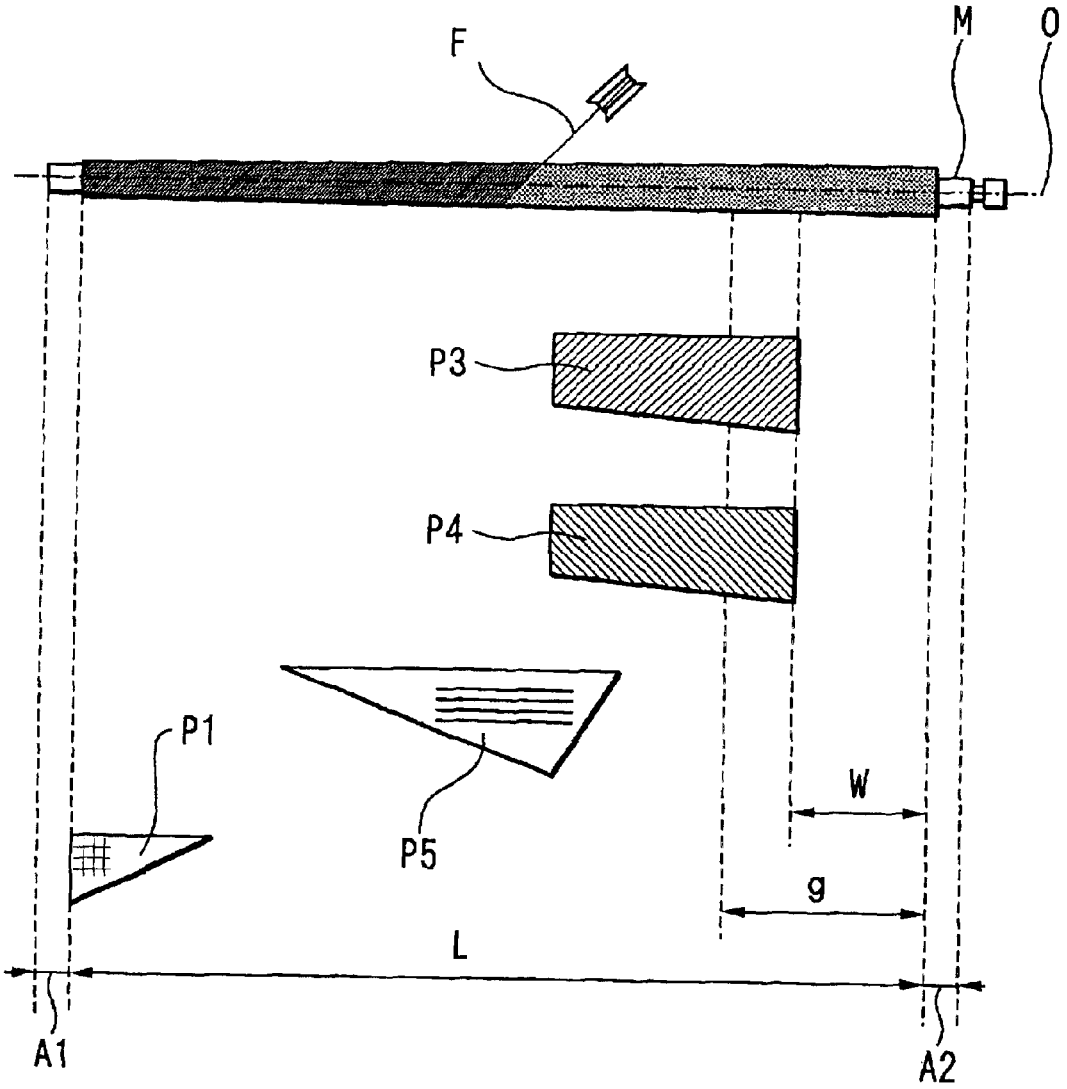
FIG. 11 shows another form of the forming process shown in FIG. 4.

The embodiments so far explained assume that the main layer 1 is formed from a sheet of prepreg made of high-strength high-elasticity fiber (carbon fiber) hardened with resin (sheet winding method); however, the invention is not limited to the above-mentioned embodiments. For instance, as shown in FIG. 11, the main layer 1 may be formed by winding resin-impregnated filament F on the mandrel M (filament winding method).

In the above-mentioned golf shaft forming process, after winding the forming material (prepreg, filament, etc) on the mandrel M and baking, the surface of the formed shaft is ground to remove traces of tape wrapping and achieve the required flexural rigidity. Concretely, at the initial designing stage, a margin to scrape is designed in the dimensions of the shaft (flexural rigidity is set higher than the intended level) and the fiber on the surface is scraped in order to remove traces of tape wrapping and achieve the design flexural rigidity.

In this grinding process, even when the same amount of fiber is scraped, the decrease in its flexural rigidity caused by scraping is larger as the elasticity of the fiber is higher, conversely speaking, as the elasticity of the fiber is lower, the decrease in the flexural rigidity caused by scraping is smaller.

The present invention takes advantage of this fact. In other words, the invention effectively utilizes rigidity variation as caused by grinding in order to control flexural rigidity distribution partially.

Specifically, a prepreg made of low-elasticity fiber (low-elasticity prepreg) is partially disposed on the surface of the shaft being formed and the whole surface of the shaft is ground uniformly (namely the depth of scraping from the surface is virtually constant); by doing so, after grinding, the flexural rigidity of the area covered by the prepreg of low-elasticity fiber is higher than the other areas. In short, the same effect as when reinforcement is made by an expensive prepreg of high-elasticity fiber (flexural rigidity is increased) can be obtained.

Low-elasticity prepregs as mentioned above include glass fiber prepregs and low-elasticity carbon fiber prepregs. Especially, the elasticity of glass fiber prepregs is one third of that of typical carbon fibers; still more, if a cloth woven in a lattice pattern is used, the elasticity difference is larger; as a result, the effect of rigidity variation as stated above can be fully demonstrated.

In addition, when the above-said metal wires are disposed under the above-said low-elasticity glass fiber prepreg, textural features of the metal wires such as metallic gloss can be seen through the glass fiber prepreg, producing a certain visual effect.

Taking the forming process as shown in FIG. 4 by example, the first glass prepreg P3 is wound at the larger diameter side on the main layer 1, which consists of a bias prepreg (main prepreg P1) as a carbon fiber prepreg and a straight prepreg, and the second glass prepreg P4 is further wound on the first glass prepreg P3. The first glass prepreg P3, which consists of obliquely aligned titanium wires 6 (metal wires) which are bonded to a glass fiber prepreg Pg, is wound with the titanium wires 6 inside (on the main layer 1). Like the first glass prepreg P3, the second glass prepreg P4 consists of obliquely aligned flat titanium wires 7 (metal wires) which are bonded to a glass fiber prepreg Pg; it is wound with the flat titanium wires 7 inside (on the glass fiber prepreg Pg side of the first glass prepreg P3).

As a consequence, a layer of titanium wires 6 and a layer of flat titanium wires 7 lie one upon another at the larger diameter side on the main layer 1 made of carbon fiber prepreg and a glass fiber prepreg Pg is laid over the metal wires (flat titanium wires). Therefore, wrapping tape is wound over the area from the surface of the main layer 1 at the smaller diameter side to the glass fiber prepreg Pg of the second glass prepreg P4 at the larger diameter side.

Figure 18:
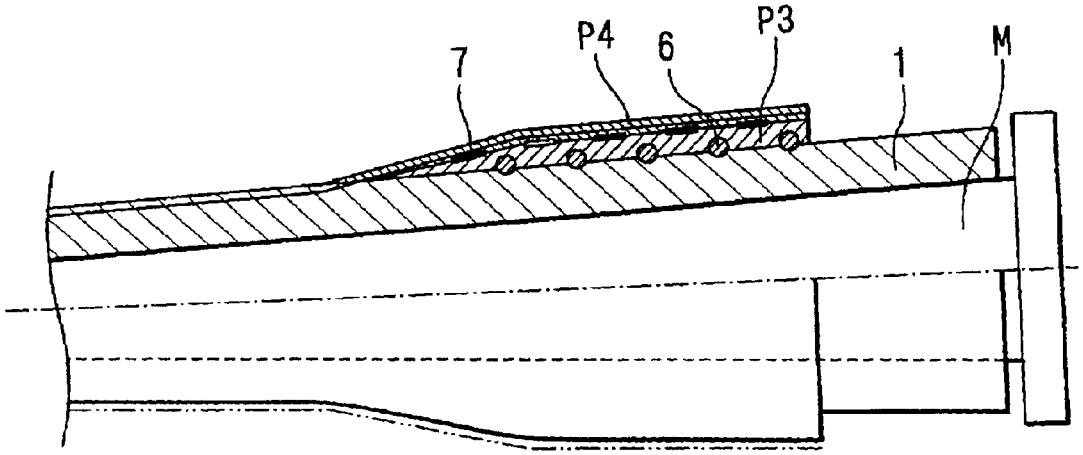
FIG. 18 illustrates the grinding process which takes place after baking.

When, in the grinding process after baking, the surface of the formed shaft is evenly scraped along its length with such a depth as to remove the traces of tape wrapping (the dash and dotted line represents the scraping depth) as shown in FIG. 18, the high-elasticity carbon fiber is scraped in the area where the main layer 1 is exposed, while, in the larger diameter side area where the second glass prepreg P4 is wound, the low-elasticity glass fiber prepreg Pg on the surface is scraped leaving the flat titanium wires 7 (metal wires) intact.

Consequently, the flexural rigidity of the larger diameter side area covered with low-elasticity prepreg (second glass prepreg P4) is higher than that of the other areas. The underlying titanium wires 6 and flat titanium wires 7 can be seen through the glass prepreg, enhancing an aesthetic design effect.

In short, the above forming method meets both a functional need and a visual need: the former is the need to control the flexural rigidity and the latter is the need to add a certain textural expression such as metallic gloss; a combination of such functional and visual features produces a favorable synergistic effect never achieved.

Also, since flat metal wires are used, the thickness of the glass/metal prepreg can be decreased and thus a texture with a more metallic touch can be created; at the same time the amount of metal or synthetic resin used can be reduced, contributing to a decrease in the overall weight.

As can be understood from the explanation made so far, according to the present invention, it is possible to effectively and easily produce a golf shaft which features lightness, high crushing strength and high torsion strength with no interlayer peeling, as well as an excellent aesthetic design with a three-dimensional effect which gives the user a sense of depth.

Also, it is possible to provide a golf shaft and a golf club which feature lightness, high crushing strength and high torsion strength with no interlayer peeling, as well as an excellent aesthetic design with a three-dimensional effect which gives the user a sense of depth.

By using low-elasticity fiber on the outermost surface of the shaft, flexural rigidity distribution of the shaft can be varied and the stability of the shaft strength can be increased.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A golf shaft produced by baking a plurality of fiber prepreg layers, the shaft being a laminate comprising:

a main layer consisting of resin-impregnated high-strength high-elasticity fiber;

a metal wire layer laid over the main layer, wherein the metal wire layer comprises a first metal wire layer and a second metal wire layer with a transparent layer disposed between the first and second metal wire layers, wherein the first metal wire layer is helically winded around the shaft and the second metal wire layer is helically winded over the first metal wire layer to form the metal wire layer; and a layer of low-elasticity fiber, laid over the metal wire layer, impregnated with resin through which the underlying metal wire layer can be seen; wherein a material layer forming an outermost protective surface overlying the second metal wire layer is in contact with the transparent layer, wherein the transparent layer is disposed across opposing planar faces of the first metal wire layer and the second metal wire layer and contacts the main layer in spaces between the first metal wire layer and contacts the layer of low-elasticity fiber layer in spaces between the second metal wire layer.

2. The golf shaft as claimed in claim 1, wherein the low-elasticity fiber layer is made of glass fiber prepreg.

3. The golf shaft as claimed in claim 1, wherein the metal wire layer is located near to the grip area along the length of the golf shaft.

4. A golf club consisting of a head set on one end of the golf shaft as claimed in claim 1 and a grip covering the other end, wherein the metal wire layer lies somewhere in the uncovered area between the head and the grip.

5. A golf shaft produced by baking a plurality of fiber prepreg layers, the shaft being a laminate comprising:

a main layer consisting of resin-impregnated high-strength high-elasticity fiber;

a metal wire layer laid over the main layer, which consists of metal wires aligned bias with respect to the axis of the main layer, wherein the metal wire layer comprises a first metal wire layer and a second metal wire layer with a transparent layer disposed between the first and second metal wire layers, wherein the first metal wire layer is helically winded around the shaft and the second metal wire layer is helically winded over the first metal wire layer to form the metal wire layer; and a layer of low-elasticity fiber, laid over the metal wire layer, impregnated with resin through which the underlying metal wire layer can be seen, wherein the metal wire layer is formed in a discrete section along a length of the shaft adjacent a grip section of the shaft.

6. The golf shaft as claimed in claim 5, wherein the low-elasticity fiber layer is made of glass fiber prepreg.

7. The golf shaft as claimed in claim 5, wherein the metal wires are spaced with a spacing 0.5 to 2 times as large as the wire width.

8. The golf shaft as claimed in claim 5, wherein the metal wire layer is located near to the grip area along the length of the golf shaft.

9. A golf shaft produced by baking a plurality of fiber prepreg layers, the shaft being a laminate comprising: a main layer consisting of resin-impregnated high-strength high-elasticity fiber; a metal wire layer laid over the main layer; and a layer of low-elasticity fiber, laid over the metal wire layer, impregnated with resin through which the underlying metal wire layer can be seen, the metal wire layer comprising: a first metal wire layer which consists of metal wires spaced and aligned bias with respect to the axis of the main layer; a transparent layer, laid over the first metal wire layer, which covers it with transparent material with a prescribed thickness; a second metal wire layer, laid over the transparent layer, which consists of metal wires spaced and aligned in the bias direction opposite to the first metal wire layer, wherein the metal wire layer is formed in a discrete section along a length of the shaft between a grip section of the shaft and another shaft section that is free of metal wires, wherein the first metal wire layer is helically winded around the shaft and the second metal wire layer is helically winded over the first metal wire layer to form the metal wire layer.

10. The golf shaft as claimed in claim 9, wherein the low-elasticity fiber layer is made of glass fiber prepreg.

11. The golf shaft as claimed in claim 9, wherein the transparent layer has a thickness from 10 $\mu$m to 100 $\mu$m.

12. The golf shaft as claimed in claim 9, wherein the transparent layer is made of glass fiber prepreg impregnated with resin having the same quality as the resin used in the main layer.

13. The golf shaft as claimed in claim 9, wherein the metal wire layer is located near to the grip area along the length of the golf shaft.

14. The golf shaft as claimed in claim 9, wherein the first metal wire layer and the second metal wire layer are located near to the grip area along the length of the golf shaft.

15. A golf shaft produced by baking a plurality of fiber prepreg layers, the shaft being a laminate comprising: a main layer consisting of resin-impregnated high-strength high-elasticity fiber; a metal wire layer, laid over the main layer, which consists of metal wires aligned bias with respect to the axis of the main layer; and a layer of low-elasticity fiber, laid over the metal wire layer, impregnated with resin through which the underlying metal wire layer can be seen, metal wire layer comprising: first metal wire layer which consists of metal wires spaced and aligned bias with respect to the axis of the main layer; transparent layer, laid over the first metal wire layer, which covers it with transparent material with a prescribed thickness; second metal wire layer, laid over the transparent layer, which consists of metal wires spaced and aligned in the bias direction opposite to the first metal wire layer, wherein a material layer forming an outermost protective surface overlying the second metal wire layer is in contact with the transparent layer, wherein the first metal wire layer is helically winded around the shaft and the second metal wire layer is helically winded over the first metal wire layer to form the metal wire layer, wherein the transparent layer is disposed across opposing planar faces of the first metal wire layer and the second metal wire layer and contacts the main layer in spaces between the first metal wire layer and contacts the layer of low-elasticity fiber layer in spaces between the second metal wire layer.

16. The golf shaft as claimed in claim 15, wherein the low-elasticity fiber layer is made of glass fiber prepreg.

17. The golf shaft as claimed in claim 15, wherein the transparent layer has a thickness from 10 $\mu$m to 100 $\mu$m.

18. The golf shaft as claimed in claim 15, wherein the transparent layer is made of glass fiber prepreg impregnated with resin having the same quality as the resin used in the main layer.

19. The golf shaft as claimed in claim 15, wherein the metal wires are spaced with a spacing 0.5 to 2 times as large as the wire width.

20. The golf shaft as claimed in claim 15, wherein the metal wire layer is located near to the grip area along the length of the golf shaft.

21. The golf shaft as claimed in claim 15, wherein the first metal wire layer and the second metal wire layer are located near to the grip area along the length of the golf shaft.

22. A golf shaft produced by baking a plurality of fiber prepreg layers, the shaft being a laminate comprising: a main layer consisting of resin-impregnated high-strength high-elasticity fiber; a metal wire layer laid over the main layer; and a layer of low-elasticity fiber, laid over the metal wire layer, impregnated with resin through which the underlying metal wire layer can be seen, metal wire layer comprising: first metal wire layer which consists of flat metal wires spaced and aligned bias with respect to the axis of the main layer; transparent layer, laid over the first metal wire layer, which covers it with transparent material with a prescribed thickness; second metal wire layer, laid over the transparent layer, which consists of flat metal wires spaced and aligned in the bias direction opposite to the first metal wire layer; wherein a material layer forming an outermost protective surface overlying the second metal wire layer is in contact with the transparent layer, wherein the first metal wire layer is helically winded around the shaft and the second metal wire layer is helically winded over the first metal wire layer to form the metal wire layer, wherein the transparent layer is disposed across opposing planar faces of the first metal wire layer and the second metal wire layer and contacts the main layer in spaces between the flat metal wires of the first metal wire layer and contacts the layer of low-elasticity fiber layer in spaces between the flat metal wires of the second metal wire layer.

23. The golf shaft as claimed in claim 22, wherein the low-elasticity fiber layer is made of glass fiber prepreg.

24. The golf shaft as claimed in claim 22, wherein the transparent layer has a thickness from 10 $\mu$m to 100 $\mu$m.

25. The golf shaft as claimed in claim 22, wherein the transparent layer is made of glass fiber prepreg impregnated with resin having the same quality as the resin used in the main layer.

26. The golf shaft as claimed in claim 22, wherein the metal wires are spaced with a spacing 0.5 to 2 times as large as the wire width.

27. The golf shaft as claimed in claim 22, wherein the metal wire layer is located near to the grip area along the length of the golf shaft.

28. The golf shaft as claimed in claim 22, wherein the first metal wire layer and the second metal wire layer are located near to the grip area along the length of the golf shaft.

29. A golf shaft produced by baking a plurality of fiber prepreg layers, the shaft being a laminate comprising: a main layer consisting of resin-impregnated high-strength high-elasticity fiber; a metal wire layer, laid over the main layer, which consists of metal wires aligned bias with respect to the axis of the main layer; and a layer of low-elasticity fiber, laid over the metal wire layer, impregnated with resin through which the underlying metal wire layer can be seen, metal wire layer comprising: a first metal wire layer which consists of flat metal wires spaced and aligned bias with respect to the axis of the main layer; a transparent layer, laid over the first metal wire layer, which covers it with transparent material with a prescribed thickness; a second metal wire layer, laid over the transparent layer, which consists of flat metal wires spaced and aligned in the bias direction opposite to the first metal wire layer, wherein the metal wire layer is formed in a discrete section along a length of the shaft between a grip section of the shaft and another shaft section that is free of metal wires, wherein the space between the flat metal wires is about 0.5 to 2 times as large as a width of the metal wires, wherein the first metal wire layer is helically winded around the shaft and the second metal wire layer is helically winded over the first metal wire layer to form the metal wire layer.

30. The golf shaft as claimed in claim 29, wherein the low-elasticity fiber layer is made of glass fiber prepreg.

31. The golf shaft as claimed in claim 29, wherein the transparent layer has a thickness from 10 $\mu$m to 100 $\mu$m.

32. The golf shaft as claimed in claim 29, wherein the transparent layer is made of glass fiber prepreg impregnated with resin having the same quality as the resin used in the main layer.

33. The golf shaft as claimed in claim 29, wherein the metal wire layer is located near to the grip area along the length of the golf shaft.

34. The golf shaft as claimed in claim 29, wherein the first metal wire layer and the second metal wire layer are located near to the grip area along the length of the golf shaft.

35. A golf shaft forming method comprising the steps of: making a main layer by winding resin-impregnated high-strength, high-elasticity fiber on a tapered mandrel; winding a first glass prepreg having aligned flat metal wires bonded to it, on the larger diameter side of the main layer with the metal wires inside; and winding a second glass prepreg having spaced and aligned flat metal wires bonded to glass fiber prepreg, on the first glass prepreg with the flat metal wires inside, wherein the flat metal wires are formed in a discrete section along a length of the shaft between a grip section of the shaft and another shaft section that is free of metal wires.

36. A golf shaft forming method comprising the steps of: making a main layer by winding resin-impregnated high-strength, high-elasticity fiber on a tapered mandrel; winding a laminate sheet having aligned metal wires between a prepreg made of the same material as the main layer and a glass fiber prepreg, on the larger diameter side of the main layer with the glass fiber prepreg inside; and winding a second glass prepreg having spaced and aligned flat metal wires bonded to glass fiber prepreg, on the laminate sheet, with the flat metal wires inside, wherein the flat metal wires are formed in a discrete section along a length of the shaft between a grip section of the shaft and another shaft section that is free of metal wires.

37. A golf shaft forming method comprising the steps of: making a main layer by winding resin-impregnated high-strength, high-elasticity fiber on a tapered mandrel; winding a laminate sheet having aligned metal wires between a prepreg made of the same material as the main layer and a glass fiber prepreg, on the larger diameter side of the main layer with the glass fiber prepreg outside; and winding a glass sheet having spaced and aligned flat metal wires between two glass fiber prepregs, on the laminate prepreg, wherein the metal wires are formed in a discrete section along a length of the shaft between a grip section of the shaft and another shaft section that is free of metal wires.

38. A golf shaft produced by baking a plurality of fiber prepreg layers, the shaft being a laminate comprising:

a main layer consisting of resin-impregnated high-strength high-elasticity fiber;

a metal wire layer laid over the main layer; and a layer of low-elasticity fiber, laid over the metal wire layer, impregnated with resin through which the underlying metal wire layer can be seen, the metal wire layer including:

a first metal wire layer formed of metal wires spaced and having a first orientation with respect to a main axis of the main layer;

a second metal wire layer formed of metal wires spaced and having a second orientation with respect to the main axis, the second orientation being different than the first orientation, wherein the second metal wire layer is spaced apart from the first metal wire layer by another layer formed therebetween, wherein the metal wires are formed in a discrete section along a length of the shaft between a grip section of the shaft and another shaft section that is free of metal wires, wherein the first metal wire layer is helically winded around the shaft and the second metal wire layer is helically winded over the first metal wire layer to form the metal wire layer.

39. The golf shaft as claimed in claim 38, wherein the metal wires in the first orientation are aligned bias with respect to the axis and the metal wires in the second orientation are aligned in the bias direction opposite to the first metal wire layer.

40. The golf shaft as claimed in claim 38, wherein the other layer between the metal wires layers comprises a transparent layer, laid over the first metal wire layer, which covers it with transparent material with a prescribed thickness.

41. The golf shaft as claimed in claim 38, wherein the other layer between the metal wires layers comprises a transparent layer, laid over the first metal wire layer, which covers it with transparent material with a prescribed thickness.

* * * * *